United States Patent [19]

Olsen et al.

[11] 4,068,565

[45] Jan. 17, 1978

[54] METHOD AND APPARATUS FOR MAKING BUSINESS FORM DUMMY

[76] Inventors: Samuel R. Olsen, 207 Data Drive, Streamwood, Ill. 60103; Robert Lapp, 5733 Grant, Hinsdale, Ill. 60521

[21] Appl. No.: 715,685

[22] Filed: Aug. 19, 1976

[51] Int. Cl.[2] ..... B31F 5/02

[52] U.S. Cl. ..... 93/1.1; 93/58 H; 93/58.3

[58] Field of Search ..... 93/1.1, 1 R, 58 R, 58 P, 93/58 H, 58.3, 58.4; 83/620, 628, 633

[56] References Cited

U.S. PATENT DOCUMENTS

| | | | |
|---|---|---|---|
| 766,905 | 8/1904 | Ruth | 93/1.1 |
| 2,638,986 | 5/1953 | Emmer | 83/633 X |
| 3,517,589 | 6/1970 | Herd et al. | 93/1.1 |

FOREIGN PATENT DOCUMENTS

| | | | |
|---|---|---|---|
| 701,749 | 12/1953 | United Kingdom | 83/633 |

*Primary Examiner*—James F. Coan

*Attorney, Agent, or Firm*—Gerald M. Newman

[57] ABSTRACT

The following specification describes a method together with portable apparatus for forming on site test dummies of stacks of business forms to provide a facsimile of actual conditions under which the paper is imprinted. This is done by simultaneously manually perforating and crimping a stack of paper containing a desired number and type then aligning a plurality of serially arranged stacks in a web by means of a splicing jig to enable the simulation of an actual run. The portable apparatus includes a plate carrying perforating and crimping dies and punches together with the splicing jig. The punches are operated by a cam having a continuous surface engaged with a punch holder. The punches protrude from the holder by different distances so that they pierce the paper at different times to reduce the manual force required for operation.

17 Claims, 5 Drawing Figures

METHOD AND APPARATUS FOR MAKING BUSINESS FORM DUMMY

BACKGROUND OF THE INVENTION

1. Field of the Invention

This invention relates in general to a method and apparatus for assembling a stack of business forms in a test dummy and more particularly to an improved and more versatile method and manually operable apparatus for economically assembling print out paper for on site test purposes to more accurately reflect actual operating conditions.

2. Summary of the Prior Art

Computer print out paper or business forms are arranged in a stack, which today contain as many as, for example, 15 copies and interleaved carbons for imprinting by computer print out machines, as against only three or four copies used in previous years. These copies must be accurately imprinted, however the great variety in the character of the paper, the carbons and the type and condition of the print-out machine requires that the paper and carbon be carefully selected and positioned in accordance with the character of the machine in order to accurately imprint all copies in stacks of this size.

It is therefore a custom in the business of supplying such forms to test the paper prior to purchase by running a test dummy or stack through the customer's print-out machine to simulate actual running or operating conditions for determining such factors as proper paper weight or character.

In such facsimile of operating conditions, the salesman will make up a stack or manifold of business forms containing a desired number of papers of various thicknesses at selected locations in the stack together with interleaved carbon paper. The carbon paper is required in the event the paper does not have transfer means. This is usually done by inserting the paper sheets and interleaved carbon in a pocket carrier strip to which the front and back sheets of the stack are pasted with a window in the carrier permitting printing of the stack. Since the carrier is quite thick, adjustment of the print out machine to reflect the actual stack thickness is not feasible nor is proper tension provided on the paper, since only the carrier feed holes are engaged with the printer traction pins during the test run. Thus most of the forms and their carbons are simply floated in the carrier. In addition the window in the carrier being cut to a smaller dimension than the paper creates a framing effect and an unrealistic print image.

Another approach is to use live samples for the test run. The use of live samples on the other hand often requires the acquisition of a stack of previously manufactured paper forms, peeling them apart and re-collation or recombination to create the desired combinations. There is no effective means of fastening the stack of re-combinations, which are therefore difficult to run. Since the old carbon paper in the original stack can provide a better image than fresh carbon paper these re-combined stacks are in addition to being time consuming to assemble also are inappropriate for accurately reflecting actual operating or running conditions.

A third approach is to machine manufacture the test samples prior to test, however, so many combinations of paper numbers and thicknesses are required that this is not a viable alternative, especially since an inventory is necessary to avoid setting up the machine just prior to a test. An inventory in turn leads to aging of the carbon paper.

Because of the many variables and the failure of the test dummies to accurately reflect operating conditions, disputes often arise as to the source of subsequent problems, which may lie either in the paper, the carbon or in the machine adjustment or character.

SUMMARY OF THE INVENTION

The present invention proposes a solution to the aforementioned problems by providing a test dummy comprising a stack or manifold of business forms which accurately simulate operating conditions. This is done despite the large stack thickness and large number of required holes by means of portable apparatus enabling the facile manual simultaneous perforation and crimping of the stack. The crimping holds the papers of the stack together for forming a test dummy. The perforations fit the printer traction pins so that each paper is under tension. The need for a carrier therefore is eliminated so that the printer or print out machine may be adjusted for actual stack thickness. In addition a group of said stacks are spliced in end-to-end relationship to form a web and so that they can be folded zig-zag fashion in a pile for simulating the actual condition in which they are drawn in sequence to the printer.

The portable manually operable perforating and crimping apparatus is carried on a common base plate so that a number of diffirent stacks may be easily assembled on the customer's premises. The plate also carries a splicing jig to permit the stacks to be assembled in serial end-to-end relationship to form a web.

The perforating and crimping apparatus includes a punch and die assembly of economical manufacture utilizing a common cam surface to simultaneously operate both the perforating and crimping punches carried in a common punch holder. The perforating punches are located in vertically offset positions so that they sequentially perforate the stack with a minimum of manual force.

With this arrangement test dummies or stacks may be easily made up on site with different numbers or paper thicknesses and/or carbon combinations and when a suitable combination is found, it may be cut into separate portions each containing the papers of the stack and one portion retained by the customer and the others by the vendor and manufacturing plant respectively for subsequent reference and comparison with the later delivered product to resolve questions or disputes.

It is therefore among the primary objects of the present invention to provide an improved and more economical method and/or apparatus for forming a business form test dummy capable of providing an accurate facsimile of actual operating conditions.

Other objects and features of the present invention will become apparent on examination of the following specification and claims together with the drawings.

DESCRIPTION OF THE PREFERRED EMBODIMENT

Figure 1:
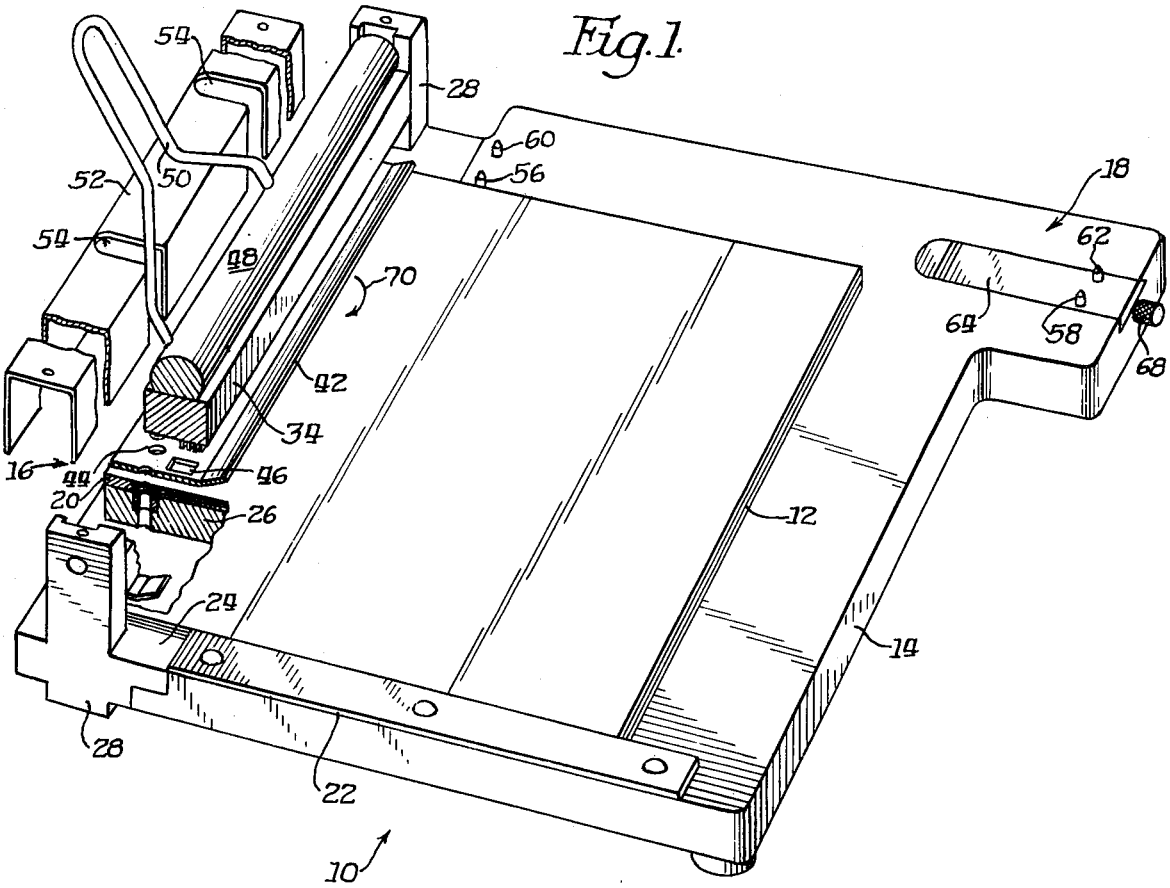
FIG. 1 is an isometric view partially broken apart and partially exploded of the apparatus utilized in practicing the invention.
Figure 2:
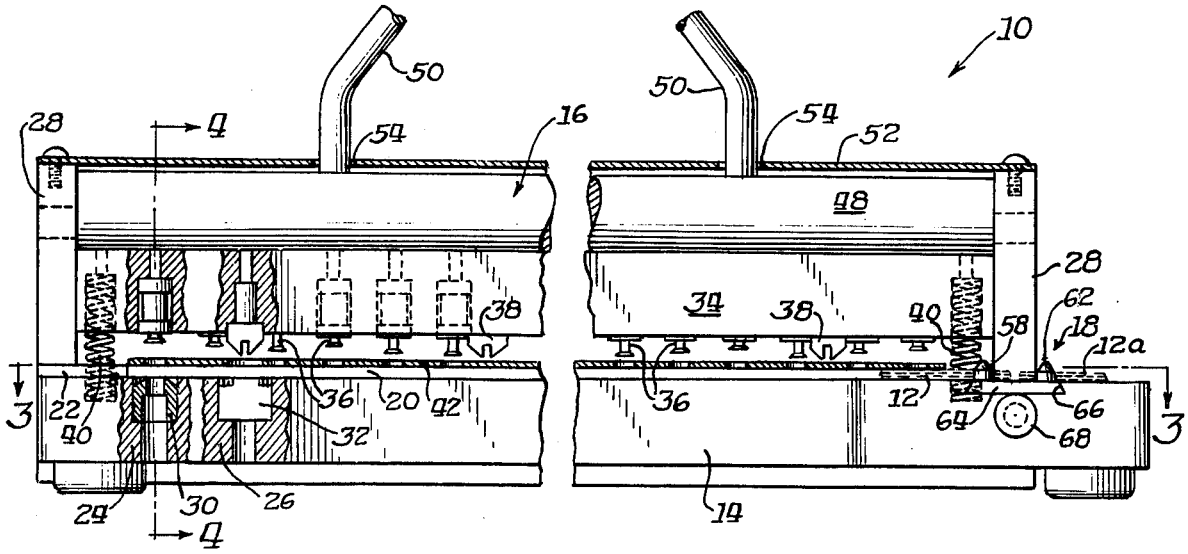
FIG. 2 is a front elevational view partially broken away of the apparatus shown in FIG. 1.

An assembly 10 for manually perforating and crimping a stack or sandwich 12 of test dummy business forms with interleaved carbon papers is shown in FIGS. 1 and 2. The assembly 10 is a dummy maker and comprises a base plate 14 having an elongate punch and die set or assembly 16 located parallel to and adjacent one edge of the plate 14. A splicing jig assembly 18 is located adjacent another edge of plate 14 transverse to the one edge. A stop rail or locating bar 20 is positioned parallel to the elongate axis of the assembly 16 for locating one edge of the stack 12 relative the assembly 16. A second stop rail or locating bar 22 extends perpendicular to bar 20 and along a perpendicular edge of plate 14 spaced from the splicing jig assembly 18 to properly position the stack 12 longitudinally relative the punch and die assembly 16.

The punch and die assembly 16 comprises a support plate 24 which is fixed to plate 14 along one nestingly engaged overlapping edge of each plate. Plate 24 includes a die block portion 26 between a pair of standards or guide blocks 28.

The die block portion 26 is provided with a series of perforating dies 30 seen in FIG. 2 longitudinally aligned parallel to the longitudinal axis of the block 26 and a smaller series of crimp or lance die buttons 32 also longitudinally aligned parallel to but offset from the series of perforating dies 30 for enabling the stack 12 to be perforated and crimped in one operation.

A punch holder 34 is located above the die block portion 26 with the ends of the holder 34 located in and guided by the standards 28 for movement perpendicular to the plane of plate 14. The punch holder 34 carries a series of perforating punches 36 each aligned with a respective one of the perforating dies 30 and a series of crimp or lance punches 38 each aligned with a respective one of the lance dies or buttons 32. The perforating dies 30 and flat face punches 36 together with lance dies 32 and punches 38 are of conventional design and fixed in the respective block for perforating the stack 12 in a conventional fashion with as many as twenty two 5/32 inch perforations spaced on 0.5 inch centers and as many as five crimps. The punch holder 34 is biased upwardly from the die block portion 26 by a pair of spaced springs 40 each located adjacent a respective one of the standards 28.

The locating bar 20 is actually fixed to one edge of plate 24 and it carries a guide plate or stripper 42 which extends between the die block portion 26 and the punch holder 34 for guiding and holding stack 12 between the punches and dies. A series of openings 44 and 46 each aligned with one of the perforating punches and lance punches respectively are formed in the guide plate 42 to permit the punches to pass therethrough. The guide plate 42 also has the important function of preventing the endge of any papers in stack 12 from overriding the bar 20 and becoming misaligned.

A solid elongate cam 48 is engaged with the upper surface of the punch holder 34 and is pivotally supported adjacent the upper ends of the standards 28 for eccentric movement of the accurate cam surface to move the punch holder 34 toward the plate 24.

Figure 4:
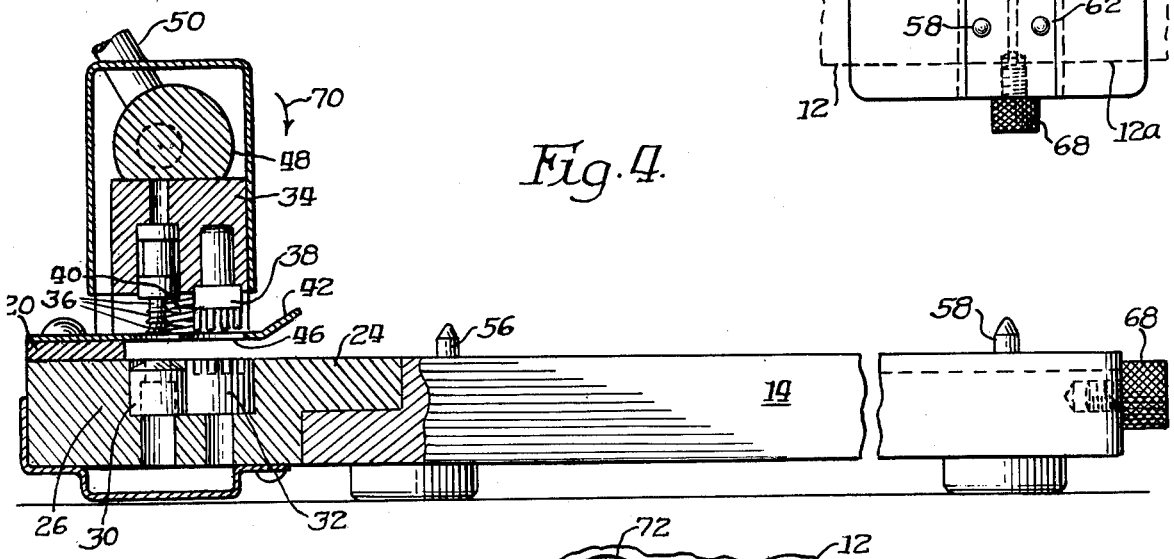
FIG. 4 is a sectional view taken generally along the line 4—4 of FIG. 2.

The cam 48 is provided with a flat surface portion which engages the flat upper surface of the punch holder in the home or rest position of the punch holder as best seen in FIG. 4. The flat surface portion on the cam provides a rest position for the cam in the normal upward movement of the punch holder under the spring force, since the corners of the flat resist additional rotation and ensures that the cam has a stable orientation relative the punch holder. A wire or rod handle 50 having spaced legs fixed to the cam 48 permits the cam 48 to be manually rotated about the pivot against the bias of springs 40 for driving the punch holder 34 downwardly to perforate and crimp the stack 12. It will be noted that the cam 48 is provided with a continuous surface in engagement with a continuous surface on the punch holder extending between the spaced punches to simplify the construction of the cam and punch holder. In addition the handle provides considerable force multiplication, since the handle length is substantially longer than the maximum cam radius.

The flat faced punches 36 project different distances below the punch holder 34 so that they engage the stack at different portions of the perforating and crimping stroke or cycle. Thus different groups or gangs of punches 36 perforate the stack 12 in sequence substantially reducing the manual force required to operate the ganged punches.

A canopy or housing 52 is fixed to the upper surface of the standards 28 and it has a pair of spaced slots 54 through which the handle legs pass with the back wall of the slots serving to prevent the cam from being driven in a direction reverse to that for proper perforation and crimping.

Figure 3:
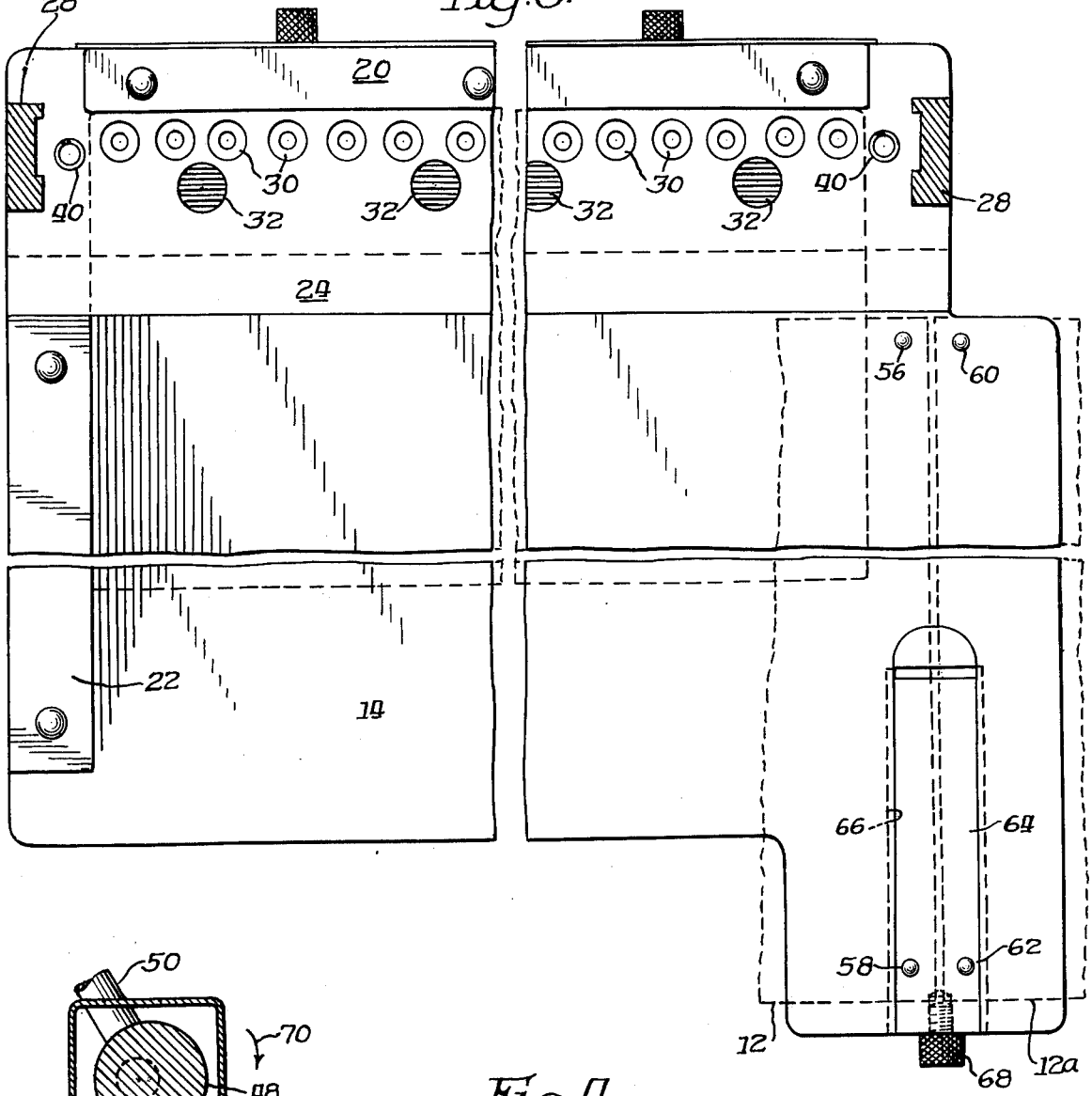
FIG. 3 is a sectional view taken generally along the line 3—3 in FIG. 2.

The splicing jig 18 comprises two pair of bullet nosed locating pins 56, 58, 60 and 62 with one pair of pins 56 and 58 spaced from the other pair of pins 60 and 62 by a distance sufficient to accommodate the edges of two stacks as indicated by the lines 12 and **12*a* in FIGS. 2 and 3. The pins 58 and 62 are carried in a block 64 having dovetail edges for receipt in a dovetail guide 66 formed in plate 14 to permit longitudinal adjustment of pins 58 and 62 relative pins 58 and 60 under control of a stop nut 68. The block 64 is reversible in the guide 66 for positioning pins 58 and 62** to receive either the 8½ inch or 11 inch edge of the forms respectively.

In operation a stack 12 is formed by collating a desired number of business forms or papers of selected thickness at various positions in the stack, which is appropriately interleaved with carbon paper, if the forms do not carry reproducing means. The stack which may contain as many as fifteen forms and fourteen carbons is inserted beneath guide plate 42 and between the punch holder 34 and the die block portion 26 with one 8½ inch or 11 inch edge, as required, of the stack 12 located against the bar 20 and a perpendicular or transverse edge of the stack abutting bar 22 to properly locate the stack relative the punches and dies. The handle 50 is now operated in the direction of arrow 70 to rotate the cam 48 through an arc, which drives the punch holder 34 far enough toward the plate 24 against the bias of the springs 40 and with sufficient force to perforate and crimp the stack. The force necessary to perforate the stack is greatly reduced by the projecting ends of the punches engaging the stack at three different portions of the cycle to avoid the large manual force required to simultaneously pierce all holes with the large numbers and size of the punches. The handle size and length provides sufficient leverage to be exerted for perforating the stack.

Figure 5:
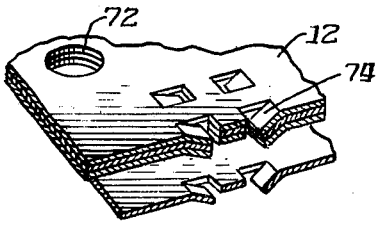
FIG. 5 is a fragmentary enlarged view of a portion of the stack to illustrate the perforation and crimping.

The stack being perforated and crimped along one edge as indicated by the perforation 72 and crimp 74 shown in FIG. 5 is now removed from between the punch holder and die block and the opposite edge of the stack inserted for perforating and crimping the opposite stack edge. With the stack perforated and crimped along both edges it is now held securely together by the crimp and may be easily handled.

When several stacks or manifolds have been composed, the perforations of one stack 12 may be engaged with pins 56 and 58, while the corresponding perforations of another stack 12*a* are engaged with pins 60 and 62 of the splicing jig 18 and shown in FIGS. 2 and 3. The exposed surface of each stack between the pins is now taped with a conventional splicing tape and the two stacks removed from the pins and the opposite surface between the two edges taped after alignment on the pins of the splicing jig. The pins 58 and 62 are of course adjustably positioned relative pins 56 and 60 to accommodate different paper widths or perforation spacing. In this manner a series of stacks may be strung serially together and these may be folded along the taped edges to form a package for simulating a complete run through the print out machine.

After a run in which a satisfactory paper combination is found, the stack may be sliced into parts with one part left with the purchaser and the other parts retained by the vendor or manufacturer for further or future comparison or reference in the event of a question as to whether a fault lies with the paper or with the machine adjustment.

The foregoing constitutes a description of an improved method and/or apparatus for forming a test dummy of business forms whose inventive concepts are believed set forth in the accompanying claims.

What is claimed is:

1. A method for forming a test dummy of business forms for imprinting by a business machine having a plurality of spaced apart traction pins for moving said forms through said machine comprising the steps of:

collating a selected variable number of paper business forms including interleaved carbon papers of variable thickness to create a stack having one common longitudinal edge;

moving said edge a predetermined distance past a plurality of perforating dies each spaced by a distance corresponding to the spacing between each pair of traction pins and a respective aligned perforating punch with said dies and punches longitudinally aligned parallel to said edge and past a plurality of crimping dies each having an aligned respective crimping punch to position said stack between all of said punches and dies; and simultaneously and manually operating all of said punches relative to all of said dies while said stack is stationary for both piercing and crimping said stack at a plurality of spaced positions adjacent said one edge of said stack to form a series of first perforations spaced apart by a distance corresponding to the distance between said spaced apart traction pins and spaced from said one edge by said predetermined distance.

2. The method claimed in claim 1, in which papers and carbons of different thicknesses are located at selected positions in said stack, and another longitudinal edge parallel to said one edge of said stack is thereafter moved said predetermined distance past all of said perforating dies and all of said punches are thereafter moved relative to all of said dies to form a second series of spaced apart perforations and crimp said stack adjacent said other edge.

3. The method claimed in claim 1 including the step of securing said dies, punches and pins to a common plate together with means for moving said punches relative said dies and a pair of transverse locating bars for positioning said stack relative said dies.

4. A method for forming a test dummy of business forms comprising the steps of:

collating a selected number of paper business forms to create a stack:

inserting said stack between a plurality of perforating and crimping dies each having an aligned respective punch;

simultaneously and manually operating said punches relative to said dies for piercing and crimping said stack at a plurality of spaced positions adjacent one edge of said stack, locating spaced perforations of one perforated and crimped stack on a respective pin, locating spaced perforations of a second perforated and crimped stack on a respective pin with edges of each stack in adjacent parallel positions, and securing the adjacent edges of each stack to each other to splice said stacks between the pins of one stack and the pins of the other stack.

5. Portable manually operable apparatus for punching and crimping a test dummy stack of paper business forms containing an indeterminate plurality of said forms with said forms adapted to have selected different thicknesses and located at any selected position in the stack for imprinting by a print out machine having spaced apart traction pins for moving stack, the improvement comprising:

a plate, a punch and die set carried by said plate with said punch and die set including a plurality of longitudinally aligned perforating punches and dies adapted to receive said stack of business forms therebetween and a series of longitudinally aligned crimping dies and crimping punches adapted to simultaneously receive said stack therebetween, said perforating punches each spaced from each other by a distance corresponding to the space between said spaced apart traction pins and having an aligned perforating die, and means for simultaneously manually moving all of said punches relative all of said dies for perforating each paper in said stack while said stack is stationary to enable subsequent engagement by said traction pins and for crimping said stack at a plurality of spaced positions offset from the perforating punches and dies to hold said stack in assembled condition during imprinting.

6. In the portable manually operable apparatus claimed in claim 5 a locating bar on said plate having an edge for positioning one edge of said stack parallel to the aligned perforating punches and dies, and a second locating bar on said plate for positioning another edge of said stack transverse to said first edge relative said punches and dies.

7. In the portable manually operable apparatus claimed in claim 5, a guide plate carried by one of said bars to prevent overriding of said bar by any forms of said stack.

8. In the apparatus claimed in claim 6 a punch holder in which all of said punches are carried, a pair of standards secured to said plate for movably supporting and guiding the movement of said holder toward and from said dies, and a cam bar having an eccentric surface and pivotally supported by said standards for moving said eccentric surface against said punch holder for moving said punch holder toward said dies.

9. The apparatus claimed in claim 8 in which said cam bar is in continuous engagement with said punch holder over a distance coextensive with the spacing of said longitudinally aligned punches.

10. The apparatus claimed in claim 5 in which said perforating punches project different distances toward said stack and said stack includes at least five forms for perforation by said perforating punches.

11. The apparatus claimed in claim 10 in which a carbon is interleaved between each pair of forms.

12. The apparatus claimed in claim 10 in which at least 10 perforating punches and dies together with 3 crimp punches and dies are provided.

13. The apparatus claimed in claim 12 in which said perforating punches each perforates a circular hole in said forms.

14. Portable manually operable apparatus for punching and crimping a test dummy stack of paper business forms containing an indeterminate plurality of said business forms with said forms adapted to have selected different thicknesses and located at any selected position in the stack for imprinting by a print out machine having traction pins for moving said stack, the improvement comprising:

a plate, a punch and die set carried by said plate with said punch and die set including a plurality of longitudinally aligned perforating punches and dies adapted to receive said stack of business forms therebetween and a series of aligned crimping dies and crimping punches and adapted to simultaneously receive said stack therebetween, means for simultaneously manually moving all of said punches relative all of said dies for perforating each paper in said stack to enable engagement by said traction pins and crimping said stack and at a plurality of spaced positions to hold said stack in assembled condition during imprinting, a splicing jig carried by said plate with said splicing jig including one pair of spaced pins for receiving a respective perforation adjacent one edge of one perforated stack; and another pair of spaced pins for receiving a respective perforation adjacent one edge of another perforated stack for aligning the one edge of each stack between each pair of pins to enable the aligned splicing of said stacks to each other.

15. In the apparatus claimed in claim 14 means for adjusting the spacing between one pin and another pin.

16. The apparatus claimed in claim 15 in which said adjusting means comprises a block carrying one piece of each pair and adjustably positioned relative said plate.

17. The apparatus claimed in claim 16 in which said block is reversably positioned in said plate for enabling said pins to be spaced for engaging the perforations of either an 8½ inch or 11 inch edge of said forms.

* * * * *